United States Patent [19]

Hamlin

[11] Patent Number: 4,845,901

[45] Date of Patent: Jul. 11, 1989

[54] TOOL KIT FOR FINISHING SLIDE FITTED ARTICLE OF FURNITURE

[75] Inventor: J. Edward Hamlin, Mesa, Ariz.

[73] Assignee: Bass Cabinet Manufacturing, Inc., Mesa, Ariz.

[21] Appl. No.: 95,770

[22] Filed: Sep. 14, 1987

[51] Int. Cl.[4] ..... B24D 15/02

[52] U.S. Cl. ..... 51/391; 51/205 WG; 30/482; 144/85

[58] Field of Search ..... 51/204, 205 R, 205 WG, 51/211 R, 214, 358, 391, 392; 30/481, 482, 484, 486; 144/85, 88, 90 A

[56] References Cited

U.S. PATENT DOCUMENTS

| | | | |
|---|---|---|---|
| 129,010 | 7/1872 | Dorn | 30/486 |
| 708,318 | 9/1902 | Clark | 30/484 |
| 1,576,661 | 3/1926 | Lawrence | 30/481 X |
| 2,009,389 | 7/1935 | Anderson | 51/205 WG |
| 2,852,896 | 9/1958 | Tompkins et al. | 51/204 |
| 3,714,743 | 2/1973 | Hall | 51/205 WG X |
| 4,617,765 | 10/1986 | Weiler | 51/205 WG |
| 4,630,409 | 12/1986 | Hofstetter | 51/392 X |

*Primary Examiner*—Robert P. Olszewski

*Attorney, Agent, or Firm*—Brown, Martin, Haller & McClain

[57] ABSTRACT

A tool kit for adjusting the dimensions of dovetail slots and tongues for forming joints in slide fitting parts of an article of furniture comprises at least one block having a strip-like abrasive surface sized to contact only a side wall of a slot or tongue. The block has a sliding guide surface transverse to the abrasive surface for sliding engagement with a surface of the part to be finished as the abrasive surface is rubbed against the side wall. Two different blocks may be provided, one designed for adjusting slot dimensions and the other designed for adjusting tongue dimensions.

12 Claims, 1 Drawing Sheet

TOOL KIT FOR FINISHING SLIDE FITTED ARTICLE OF FURNITURE

BACKGROUND OF THE INVENTION

The present invention relates to a tool kit for finishing a slide fitted article of furniture.

Articles of furniture such as cabinets, bookshelves, desks and the like are often shipped and sold in a knock-down form, to be assembled by the purchaser on site. Often such articles are assembled by slide fitting various parts. In U.S. Pat. No. 4,750,794 of William Vehg, a slide fitted article of furniture is described in which various parts of the article are provided with corresponding dovetail or tapered tongues and slots for sliding engagement with one another to secure the parts together on assembly.

When dovetail slots and tongues are produced on furniture parts in a mass production process, there may be some variation in dimensions so that the parts do not slide together smoothly and easily on assembly, causing some frustration and difficulty to the assembler. In some cases where the slot is too small for example, the slot may be run through the planar or router a second time during the production process to take off additional material. However the slot or tongue may warp, expand or contract after shipping and there is no convenient hand tool available for rapidly adjusting slots and tongues on slide fitted parts on assembly in the field.

SUMMARY OF THE INVENTION

It is an object of the present invention to provide a tool or tool kit for adjusting the dimensions of tongues and slots of slide fitting parts of an article of furniture on assembly.

According to the present invention, a tool for adjusting the dimensions of the tongue or slot of slide fitting furniture parts comprises a block having an elongate strip-like abrasive surface sized to contact only a side wall of a tongue or slot to adjust its dimensions, and a guide surface transverse to the abrasive surface for sliding along an adjacent surface of the part to be finished to guide the abrasive surface along the side wall. Preferably the remainder of the block has non-abrasive surfaces, so that when one side wall of a slot or tongue is being adjusted friction on other surfaces is minimal so material is only removed from one surface at a time. The block is preferably designed so that only one side wall of a slot at a time is contacted.

In the preferred embodiment of the invention the block has a gripping portion extending from the abrasive surface for gripping by a user to urge the abrasive surface against the selected tongue or groove side wall. The dimensions of the gripping portion are preferably at least four times larger than those of the abrasive surface for improved leverage.

Preferably, two different blocks are provided, one for use in adjusting the dimensions of a tongue and the other for use in adjusting the dimensions of a slot or groove. The first block has an indent or cut out extending along one edge with an abarsive strip extending along one face of the cut out for engaging the side wall of a tongue. The other face of the cut out comprises the guide surface for sliding along the end wall of the tongue to guide the abrasive strip along the side wall. The remainder of the block comprises a gripping portion for gripping by the user to urge the abrasive strip against the appropriate side wall so that its dimensions are reduced. Preferably, the overall height of the block is at least five times the width of the abrasive strip, which is suitably of sandpaper. In the case of dovetail tongue and slot joints, the abrasive surface will be angled to correspond to the angle or taper of the tongue.

The other block has a tongue extending from one of its faces for engagement in a groove or slot of a slide fitting part with some free play, the tongue having opposite side walls with an abrasive strip, suitably of sandpaper, extending along one of the side walls comprising the abrasive surface. The face of the block adjacent the tongue comprises the guide surface which slides along the face of the part to be finished adjacent the slot to guide the abrasive surface along the selected side wall of the slot. The other side wall of the tongue is preferably non-abrasive and is spaced from a side wall of the groove when the abrasive surface contacts the opposite side wall, so that material can be removed from one side wall only without applying any friction to the other surfaces of the slot or groove. If both side walls need to be adjusted, the abrasive surface can first be rubbed against one side wall until the offending material is removed, and the tool can then be reversed so that the abrasive surface contacts the opposite side wall. In the case of a dovetail groove, the side wall of the block tongue to which the abrasive strip is secured will be inclined at approximately the same angle as the side walls of the dovetail groove.

Thus only two simple, easy to use handtools are reuired for finishing the dovetail tongue and grooves of slide fitting furniture parts on assembly, so that if any particular sliding joint jams for some reason, the offending tongue or slot can be adjusted quickly and easily to remove the excess material to allow a sliding fit between the parts.

BRIEF DESCRIPTION OF THE DRAWINGS

The present invention will be better understood from the following detailed description of a preferred embodiment, taken in conjunction with the accompanying drawings, in which like reference numerals refer to like parts and in which.

DESCRIPTION OF THE PREFERRED EMBODIMENT

Figure 1:
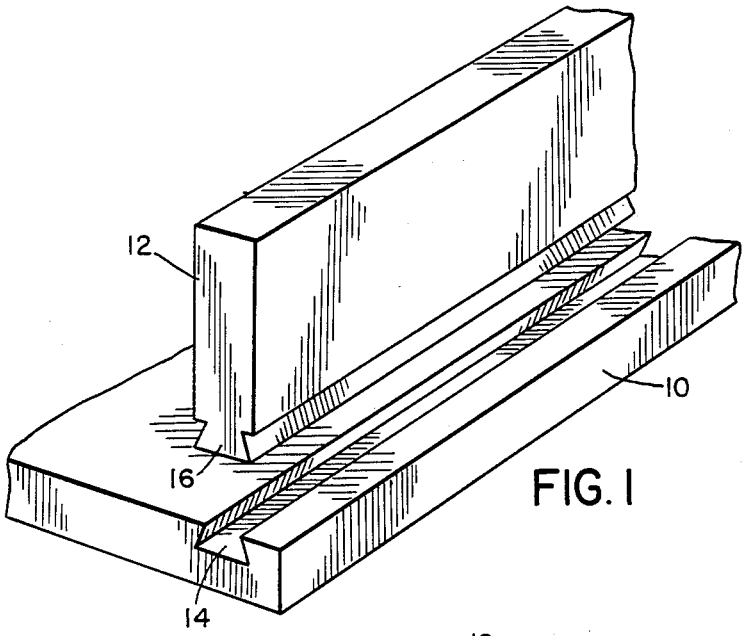
FIG. 1 is a perspective view of two typical dovetailed components to be interfitted.

FIG. 1 shows two typical dovetail components 10, 12 to be interfitted. A joint is formed between a horizontal dove-tailed mortise groove or slot 10 on a first part 10 of an article of furniture, and a corresponding flaring tenon tongue 16 on the second part 12 of the article of furniture. The joint is made by sliding tongue 16 lengthwise into engagement with the groove 14. Such joints may be used in any knock-down article of furniture for assembly on site, such as cupboards, shelving units, desks and the like.

Figure 2:
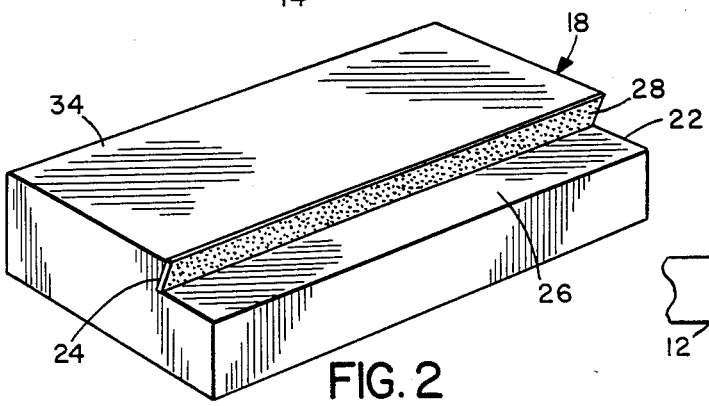
FIG. 2 is a perspective view of a sanding block according to a preferred embodiment of the invention for trimming the tongue element of one dovetailed component.
Figure 3:
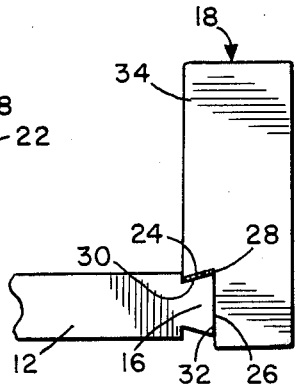
FIG. 3 is an end elevation view showing the sanding block of FIG. 2 in use.
Figure 4:
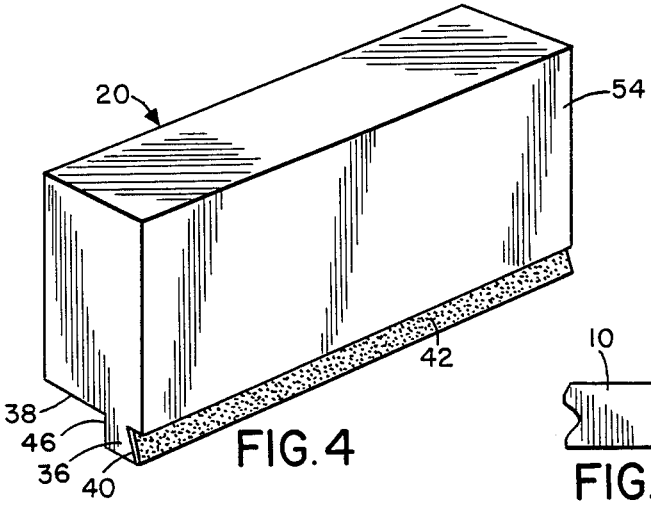
FIG. 4 is a perspective view of the sanding block according to the preferred embodiment of the invention for trimming the groove portion of the other dovetailed component.

FIGS. 2 to 4 of the drawings show a tool kit comprising two sanding blocks according to a preferred embodiment of the invention for adjusting the dimensions of a tongue and groove of slide fitting parts of an article of furniture as shown in FIG. 1. Such a tool kit may be used, for example, for on site finishing of a slide fitted article of furniture as described in U.S. Pat. No. 4,750,794 of William Vegh, or for finishing a slide fitting tongue and groove on any knock-down piece of furniture.

The kit comprises two similar block-like tools 18, 20 shown in FIGS. 2 and 4 respectively, which are designed for finishing a dovetail tongue and dovetail groove, respectively. Each tool comprises a block having a strip-like abrasive surface designed to contact only a side wall of a respective tongue or slot, with the remainder of the block preferably having non-abrasive surfaces.

Figure 5:
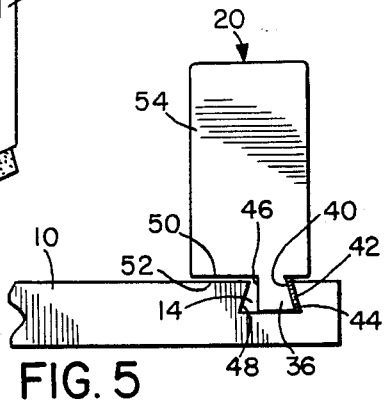
FIG. 5 is an end elevation view of the sanding block of FIG. 4 in use.

FIG. 2 shows the first tool 18 forming part of the kit for adjusting the dimensions of a tongue 16 as indicated in FIG. 3, while FIG. 4 shows the second tool 20 which is designed for adjusting the dimensions of a groove 14, as indicated in FIG. 5.

The first block 18 is a generally rectangular block of wood or similar material having an indent or cut-out 22 extending along one of its edges. One face 24 of the cut-out is inclined or tapered and is of less thickness than the other face 26. A strip 28 of sandpaper or similar abrasive material extends along face 24, to form an abrasive surface for rubbing against a side wall 30 of a tongue 16 of a slide fitting furniture part 12. The abrasive surface 28 is designed to contact only the selected side face 30 of the tongue 16. Face 26 comprises a guide surface for sliding engagement with end face 32 of tongue 16 as the face 24 is rubbed along the side wall 30, as shown in FIG. 3. The inclination of face 24 corresponds substantially with that of side wall 30, and the engagement of guide face 26 with end wall 32 inherently guides the abrasive surface to maintain the correct angle for face to face engagement with side wall 30.

The remainder of block 18 comprises a gripping portion 34 for gripping by a user to apply pressure to side wall 30, the dimensions of the gripping portion being larger than those of the abrasive surface. In the preferred embodiment the height of the gripping portion 34 is at least five times that of strip 28. Thus the gripping portion of the block is large enough to allow significant leverage to be applied to the tool to generate a high pressure of surface 28 against side wall 30.

Although this tool is designed to contact only one side wall at a time, and is reversed if the other side wall also needs adjustment, with abrasive or sandpaper strip 28 comprising the only abrasive surface of the tool, it may be designed with a groove rather than a two sided cut out as shown, with each side wall of the groove provided with an abrasive strip. The groove will be of larger dimensions than tongue 16 so that it engages over the tongue with some free play. One abrasive surface can then be urged against one of the side walls of the tongue to remove excess material, with the other abrasive surface spaced from the opposite side wall. Once the first side wall has been adjusted satisfactorily, the other abrasive surface is then rubbed against the opposite side wall for a similar adjustment. In this case the tool does not have to be reversed.

The second tool 20 of the kit also comprises a block as shown in FIG. 4, which is suitably of wood. The block 20 has a tongue 36 extending from one of its faces 38 for sliding engagement in the groove or slot 14 of a slide fitting furniture part with some free play as indicated in FIG. 5. At least one side face 40 of the tongue is inclined and has a strip 42 of sandpaper or other abrasive material extending along its length, forming an abrasive surface for rubbing against a side wall 44 of the groove 14. Thus the angle of surface 40 substantially corresponds to the taper angle of groove side wall 44, and the surface is sized to contact only the selected groove side wall, so that material is removed from that surface only.

The other side face 46 of the tongue is preferably nonabrasive is not inclined and is not intended to contact a side wall of the groove 14. However, in an alternative embodiment face 46 could also be covered with a strip of abrasive material to rub against the opposite groove side wall 48.

The tongue preferably extends from one side of face 38 with the remainder of the face comprising a guide surface 50 which engages the upper surface 52 of part 16 adjacent the groove while the tongue runs along the groove as indicated in FIG. 5. This helps to guide the abrasive surface against the respective groove side wall at the correct angle.

The remainder of the block comprises a gripping portion 54 for gripping by a user to force the tongue along the groove while pushing the abrasive surface against a side wall of the groove to remove material from the side wall in a grinding or rubbing action. The height of portion 54 is preferably greater than the height of the abasive strip, for added leverage, and in the preferred embodiment shown the height of gripping portion 54 is at least five times that of the strip.

In each of the blocks the sanding or abrasive surface is sized to contact only a side wall of the dovetail slot or groove, and the leverage area is large relative to the sanding or abrasive area. Thus the user can concentrate on removing material from one side wall only while minimal or no friction will be applied to the other surfaces, and the large leverage area allows the user to apply a high pressure to the abrasive surface so that sufficient material can normally be removed from an offending surface after only one or two passes of the tool.

The tongue of tool 20 is small enough to be pushed to either side of the groove 10 without contacting the opposite side, whether it has only one abrasive strip or is a double sided tongue with abrasive strips along both side walls, so that the tool engages only one side of the groove at a time and can be rubbed against that side with a relatively high force to remove excess material rapidly and easily and to smooth the surface. Thus the width of the top of the tongue will be less than that of the top of the groove 14. For example, if the top of groove 14 has a width of around 3/8 inch, the width of the top of the tongue would preferably be around 1/4 inch. Similar relative dimensions apply where block 18 has a double sided groove rather than a cut out.

Thus the tool kit of this invention provides two easy-to-use hand tools for adjusting the dimensions of interfitting dovetail tongues and grooves quickly and easily.

Although a preferred embodiment of the invention has been described above by way of example only, it will be understood by those skilled in the field that modifications may be made to the disclosed embodiment without departing from the scope of the invention, which is defined by the appended claims.

I claim:

1. A tool for adjusting the dimensions of slide fitting parts of an article of furniture, one of the parts having a groove and the other part having a tongue for sliding engagement in the groove, the tool comprising:

a block having a tongue projecting from one face for slideable engagement in a groove of a slide fitting part with some free play, at least one abrasive strip-like surface extending along one of the side walls of said tongue and sized to contact only a side wall of the groove for rubbing against one of the side walls of said groove as said tongue passes along said groove to adjust its dimensions, said face of said block from which said tongue projects comprising a sliding guide surface for sliding engagement with the face of said part adjacent said groove to guide the abrasive surface along said side wall of the groove.

2. The tool as claimed in claim 1, wherein the remainder of the block has non-abrasive surfaces.

3. The tool as claimed in claim 1, wherein the block has a gripping portion extending from the abrasive surface for gripping by a user to urge the abrasive surface against a selected side wall, the dimensions of the gripping portion being greater than the dimensions of the abrasive surface.

4. The tool as claimed in claim 3, wherein the height of the gripping portion is at least four times that of the abrasive surface.

5. The tool as claimed in claim 1, wherein the abrasive surface comprises a strip of sandpaper.

6. The tool as claimed in claim 1, wherein the abrasive surface is inclined at an acute angle relative to said sliding guide surface to engage the inclined side wall of a dovetail groove.

7. A tool kit for adjusting the dimensions of a slide fitting tongue and groove on two parts of an article of furniture, the tool kit comprising a first tool for adjusting the dimensions of the groove and a second tool for adjusting the dimensions of the tongue, each tool comprising a block having an abrasive, elongate strip-like surface sized to contact only a selected side wall of the respective tongue or groove and a sliding guide surface extending transverse to the abrasive surface for sliding engagement with an adjacent surface of the respective part for guiding the abrasive surface along the side wall.

8. The tool kit as claimed in claim 7, wherein each block has a gripping portion for gripping by a user as the abrasive surface is rubbed along a side wall of the respective tongue or groove.

9. The tool kit as claimed in claim 8, wherein the dimensions of the gripping portion are at least three times greater than the dimensions of the abrasive surface.

10. The tool kit as claimed in claim 7, wherein the first tool comprises a block having a tongue projecting from one face for sliding engagement in a groove of a slide fitting part with some free play, the tongue having opposite side faces and an abrasive strip extending along one side face comprising said abrasive surface for rubbing against a side wall of the groove, said one face from which said tongue projects comprising said sliding guide surface for engaging a face of said part adjacent said groove.

11. The tool kit as claimed in claim 10, wherein the other side wall of the tongue is a non-abrasive surface and is spaced from a side wall of the groove when the abrasive strip contacts the other side wall of the groove.

12. The tool kit as claimed in claim 10, wherein the tongue is non-centrally located on said one face, the side wall of the tongue having the abrasive strip being located adjacent one end edge of said face.

* * * * *